United States Patent [19]

Skewis

[11] Patent Number: 4,846,432

[45] Date of Patent: Jul. 11, 1989

[54] FOLDABLE WORK STAND

[76] Inventor: William A. Skewis, 171 W. Spruce St., Sequim, Wash. 98382

[21] Appl. No.: 174,160

[22] Filed: Mar. 28, 1988

[51] Int. Cl.[4] ..... A47B 9/02

[52] U.S. Cl. ..... 248/235; 211/149; 108/135; 248/240.3

[58] Field of Search ..... 248/235, 240.3, 447.2, 248/460, 236, 238, 461, 281.1, 463; 108/134, 135, 97; 211/186, 149, 90, 118

[56] References Cited

U.S. PATENT DOCUMENTS

| | | | |
|---|---|---|---|
| 543,949 | 8/1895 | Stone | 248/236 X |
| 1,903,262 | 3/1933 | Goings | 108/97 X |
| 2,179,273 | 11/1939 | Ponten et al. | 108/134 X |
| 2,512,958 | 6/1950 | Meier | 108/97 |
| 2,687,336 | 8/1954 | Smith et al. | 108/135 X |
| 2,689,022 | 9/1954 | Neilson | 248/240.3 X |
| 2,781,081 | 2/1957 | Hynes | 248/240.3 X |
| 2,893,802 | 7/1959 | Bittner | 108/135 X |
| 3,301,406 | 1/1967 | Scott | 108/97 |
| 3,741,131 | 6/1973 | Leadbetter | 108/152 X |
| 3,957,240 | 5/1976 | Johansson | 248/235 X |

*Primary Examiner*—Ramon S. Britts
*Assistant Examiner*—Karen J. Chotkowski
*Attorney, Agent, or Firm*—William I. Beach

[57] ABSTRACT

A portable working surface that can be suspended below the edge of a conventional table at a convenient height with a pair of hanger rods. Attached are two spaced pair of three arms adapted to be folded and stacked on the work surface which together with the hanger rods fit into a standard briefcase.

13 Claims, 2 Drawing Sheets

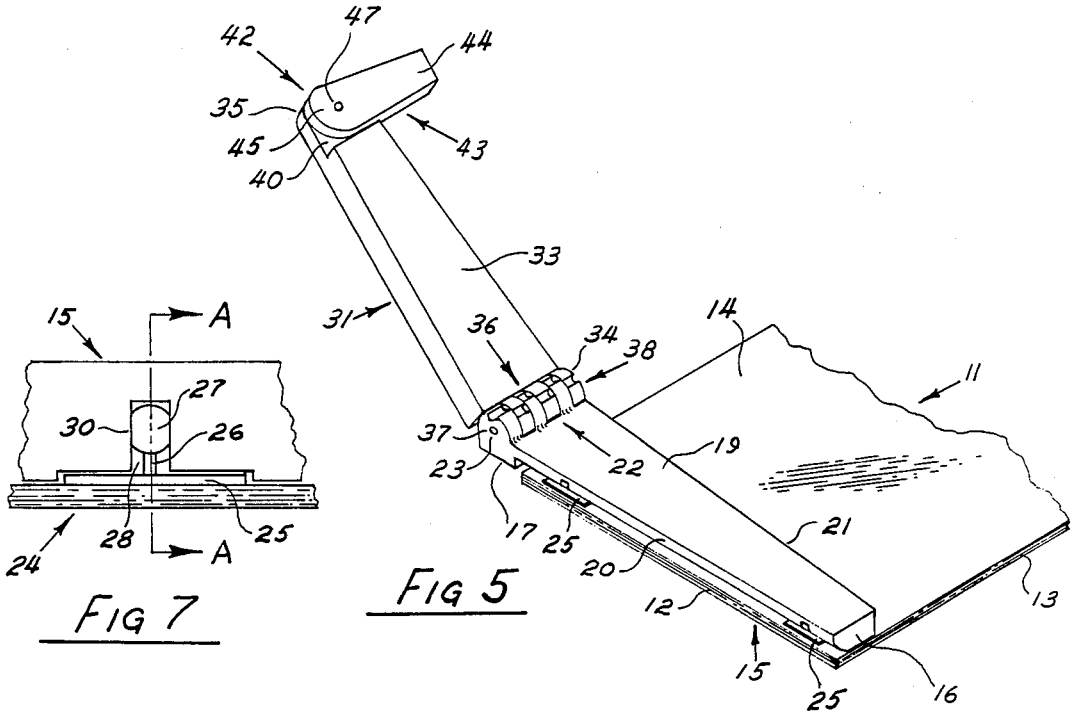
FIG 5
FIG 7
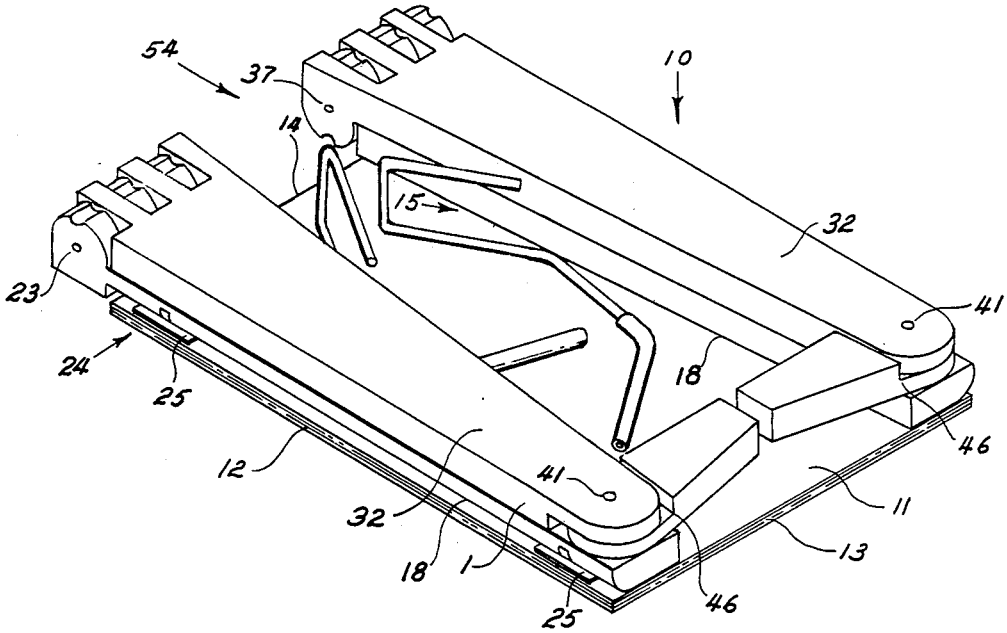
FIG 6
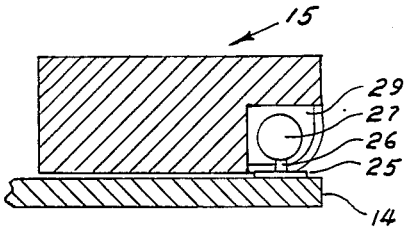
SECTION A-A
FIG 8

FOLDABLE WORK STAND

FIELD OF THE INVENTION

The present invention relates to trays, work stands and the like that are supported from conventional tables and shelves and more particularly to typewriter stands that can be folded and transported in a briefcase.

DESCRIPTION OF THE PRIOR ART

Although the specific embodiment of the subject invention was not found in a novelty search, several patents are cited herein that disclose support trays attached to normal tables in a way somewhat similar to the subject invention. Some of these protrude below the table top, for example, U.S. Pat. Nos. 2,558,323, 2,709,563 and 3,741,131. However, none appear to show structure like the present invention and none can be folded in a compact package so as to be enclosed in a conventional briefcase.

SUMMARY OF THE INVENTION

In carrying out the principles of the present invention in accordance with a preferred embodiment thereof a shelf section of a work stand has an upper and lower surface and a pair of side edges longer than the opposite side edges. Included is a pair of first foldable arms mounted separately on the lower surface along the longer side edges having outer and inner sides, edges and ends. A first hinge connection is mounted on the outer ends of the first arms including a first hole extending therethrough parallel to the sides. There is a multiplicity of space hinges with two each having one flange portion connected to the side edges of each of the first arms and the other portion to the lower surface of the shelf. The hinges rotate he sides of the first arms from the lower surface to an upright position normal thereto. There is a similar second pair of foldable arms with spaced sides, edges, ends and a second hinge connection on an inner end. A second hole is bored through the second hinge and a pin inserted therein about which the second hinge rotates on the first hinge connections. Also included is a third hinge connection on the outer end of the second arms and a third hole extending transversely therethrough. A third pair of dissimilar arms with spaced sides and ends has a fourth hinge connection on the inner end. A fourth hole bored transversely therethrough in alignment with the third hole also includes a pin for rotating the fourth hinge connection on the third hinge connection. Included is a pair of hanger rods adapted to suspend the work stand below a table top. The rods have a first horizontal leg connected to a first semi-arcuate vertical leg. At the bottom the vertical leg is a shorter second horizontal leg extending at right angle to the first horizontal leg. Connected to the outer end thereof is a shorter vertical leg which together with the first vertical leg form a U-shaped section for hooking around the bottom sides of the first hinge connections.

Means are provided in combination with the hanger rods for suspending the work stand below the table top. This includes the upper horizontal legs being placed over the edge of the table while extending the second and third arms under the table supporting rail with the third arms rotated upwardly in contact with the lower surface. Further, there is means associated with the hinges for assembling the three pairs of arms on the lower surface of the shelf. This is accomplished by folding the pair of first arms inwardly to place the inner side of the first arms on the lower surface. The second and third arms extending from the first connection are likewise folded inwardly placing the inner side of the second arms on top of the first arms. The third arms are then pivoted inwardly towards each other parallel to the lower surface. The hanger rods separated from the first arms are placed between the stacked first, second and third arms. The assembled shelf can be enclosed and transported in a brief case.

BRIEF DESCRIPTION OF THE DRAWING

FIG. 5 is a partial prospective view of FIG. 4 showing the first arm rotated 90° and the second arm being folded inwardly towards the first arm, FIG. 6 is a prospective view of the work stand with the first, second, third arms and the hanger rods assembled on the lower surface of the shelf for enclosing in a briefcase, FIG. 7 is a fragmented side view of the hinge attaching the first arm to the lower surface of the shelf, and FIG. 8 is a fragmented view of the hinge taken along line A—A of FIG. 7.

DETAILED DESCRIPTION OF THE PRESENT INVENTION

Figure 1:
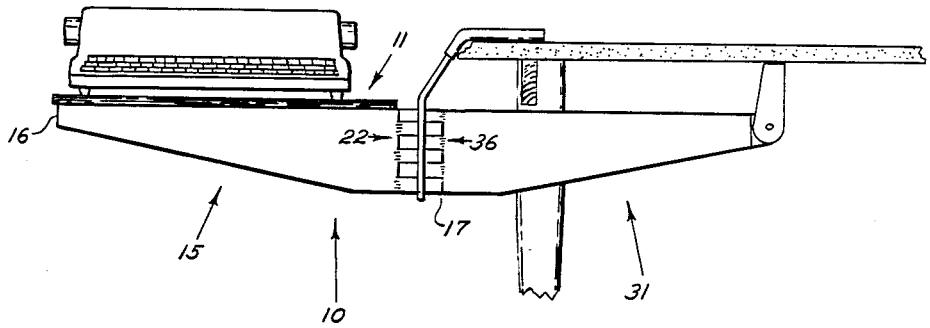
FIG. 1 is a partial side view of a preferred embodiment of the present invention showing the work stand suspended from a table top.
Figure 2:
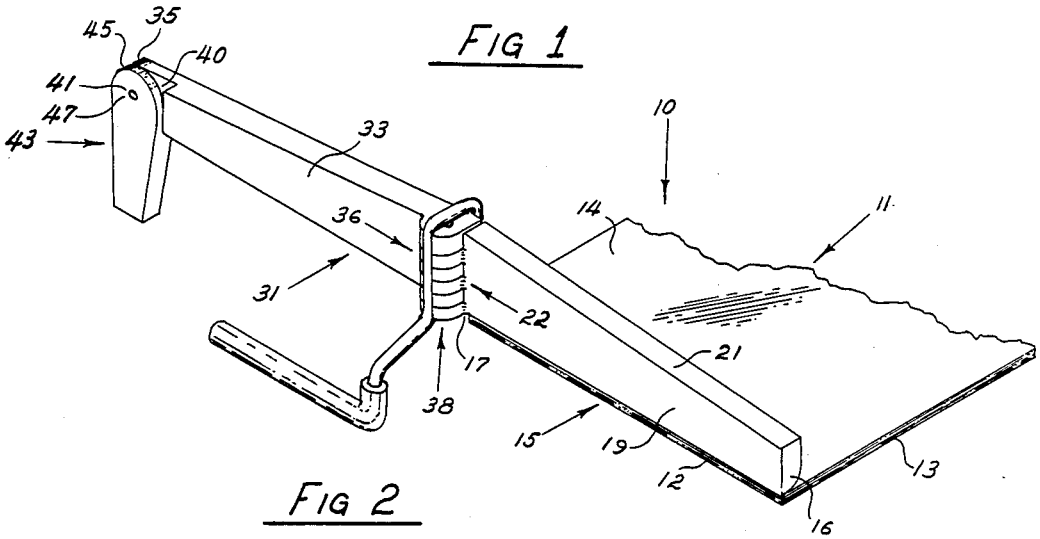
FIG. 2 is a partial prospective bottom view of the present invention removed from the table including a hanger rod hooked around the first hinge connection on one side of the shelf.
Figure 3:
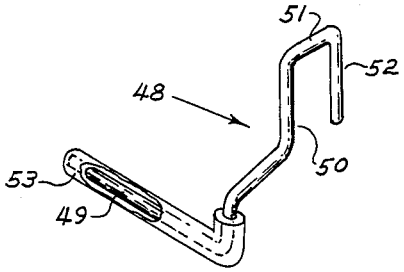
FIG. 3 is a prospective elevated view of one of the hanger rods showing a friction-like sleeve covering the first horizontal leg of the rod.
Figure 4:
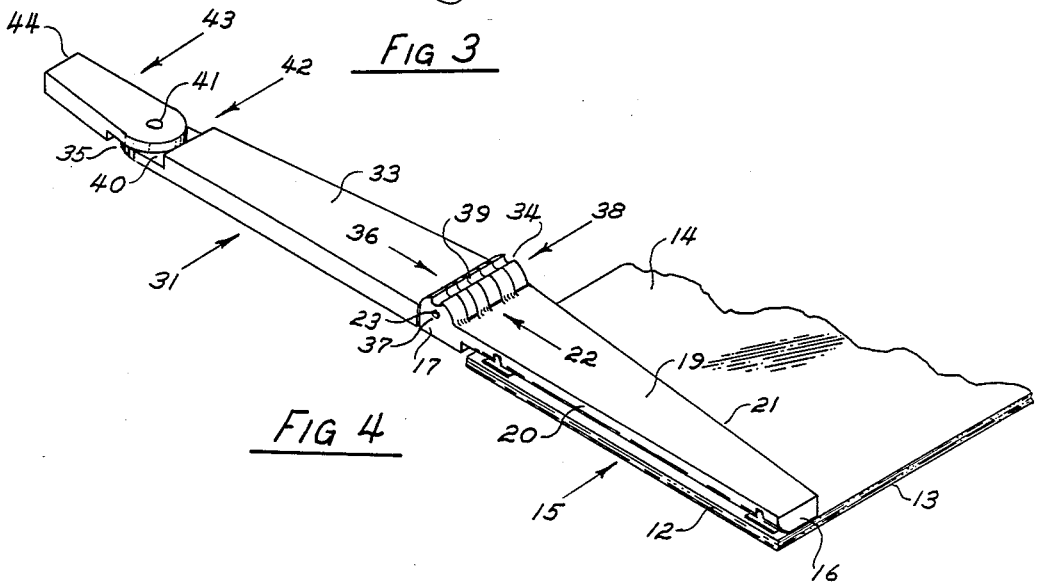
FIG. 4 is a partial prospective view of FIG. 3 showing the first, second, and third arms in folded alignment with the inner side of the first arm resting on the lower surface of the shelf.

Referring to FIG. 1–6, it can be seen that the work stand is suspended from a table top. The stand consists of work platform or shelf mounted on a pair of space first foldable arms. Rotatably connected to the first arms is a second pair of foldable arms. A third pair of rotable arms are mounted on the outer ends of the second arms adapted to rotate 90° with respect to the sides of the first and second arms. Included is a Hanger rod for supporting the work stand designed to hook underneath the pair of first arms and over the edge of the table edge.

The work stand 10 includes a relatively flat rectangular shelf 11 with the longer side edges 12, 16 inches long, and the shorter side edges 13, 10½ inches long. The dimensions of the shelf are approximately equal to the inside space of a conventional briefcase. Connected adjacent to the longer sides 12 on the lower surface 14 of the shelf is a first pair of foldable arms 15. The first foldable arms 15 have a tapered length approximately equal to the longer side edges of the shelf 11 which varies from a smaller end 16 to a larger end herein defined as the outer end 17. The tapered sides 18 and 19 also includes a bottom side edge 20 extending perpendicular to the ends 16 and 17 and an upper inclined side edge 21. At the outer end 17, the outer side 19 is expanded into an enlarged semi-cylindrical extension of the side defined as a first hinge connection 22 extending lengthwise parallel to the outer end 17. There is also a first hole 23 bored lengthwise through the center of the first hinge connection 22. The outward face side of the first hinge connection is slotted lengthwise in a line of comb-like ledges and spaces forming part of a hinge that includes a line of grooves extending lengthwise in the peripheral edge of the semi-cylindrical ledges.

There are also four ball and socket type of hinges 24 for securing the first arms 15 on the lower surface 14 of shelf 11. The flange portion 25 of two each of the hinges are attached in spaced relationship on the lower surface 14 of shelf 11. Inserted in the bottom side edge 20 of first arms 15 is the stem 26 and ball portion 27 of the hinge 24. The edge 20 has a hole 28 extending therein for entrance of the head and stem. A bearing surface 29 is disposed adjacent to the head to provide a socket for the ball 27. The inner side of the first arms 15 has a slot 30 adjacent to the hinges to allow stem 26 to swing out of the slot when the first arms are folded sideways. Although the ball and socket is described herein, it is to be understood that there are other types of hinges that will suffice for the kind of folding operation required of the first arms 15.

A second pair of foldable arms 31 is rotatably connected to the first arms 15. Second arms 31 have the same general dimensions and shape of the first arms. For identification purposes the inner and outer sides are 32 and 33 respectively. Likewise the inner and outer ends are 34 and 35 respectively. On the inner end 34 of second arms 31 is a similar expansion of the outer side 33 into a second enlarged semi-cylindrical extension defined as a second hinge connection 36. Similar to the first hinge connection, the outward face of the second connection is formed into a line of comb-like ledges and spaces adapted to mesh with the first connection. A line of grooves also extend lengthwise in the peripheral edge of the semi-cylindrical ledges of the second connection 36. The second connection is bored lengthwise with a second hole 38 in alignment with first hole 23 in the first connection 15. When meshed together such that the ledges of both connection slidably engage the spaces of the other, and the holes 23 and 37 are in alignment, a pin inserted in the holes rotatably joins both hinge connection in an interleaving hinge 38. The grooves on the opposite hinge connections never are aligned together in a straight line until the first and second arms 15 and 31 have rotated such that the outer end 17 of the first arm and the inner end 32 of the second are locked together in an abutting contact with the other. In this position the combined grooves 39 of the first and second hinge connections are in alignment. On the outer end 35 of the second arm is a third hinge connection 40 with a third hole 41 bored transversely therethrough with the inner and outer sides 32 and 33. The third hinge connection is a part of a scrafed hinge 42 adapted to dovetail with a fourth hinge connection on a third arm.

The third arm 43 has a length approximately one third of the first and second arms. The third arm has an outer end 44 and an arcuate shaped inner end 45. A fourth hinge connection 46 on the inner end 45 is a second matching section of the scarfed hinge 42, as may be seen in FIGS. 2, 4 and 5. Transversely bored through the hinge connection is a fourth hole 47. A pin inserted in the fourth hole 47 is adapted to rotate the fourth hinge connection on the third hinge connection. The pin has a threaded end and a wing nut for tightening purposes. The wing nut is not shown on the drawing.

Included with the work stand 10 is a pair of hanger rods 48 for suspending the stand from a conventional table. The rods may be formed of several types of metals. However, it is preferable that one of the lighter metals be used, such as aluminum. Essentially, the hanger rod consists of a first horizontal leg 49 connected at the inner end to a semi-arcuate vertical leg 50. Connected to the bottom of the vertical leg is a lesser horizontal leg 51 extending perpendicular to the first horizontal leg. A second lesser vertical leg 52 is connected to the outer end of the lesser horizontal leg forming a U-shaped portion. The U-shaped portion is arranged to slip under and around the interleaving hinge 38 whereby the lesser vertical leg is embedded in the combined groove 39 to prevent the work stand 10 from slipping out of the hanger rods 48. Further, a friction-like sleeve 53 covers the first horizontal leg to provide gripping pressure.

In operating the work stand two important functions are achieved. One is means for providing a typewriter work stand at a comfortable height when traveling. The other is means for folding and enclosing the work stand in a briefcase. When mounting the work stand on a table the three arms 15, 31 and 43 are unfolded and placed in lineal extension so that the second and third arms 31 and 43 project outwardly of the shelf 11. Following this, the third arm 43 is rotated 90° so that the outer end 44 extends above the shelf. The U-shaped portion of the pair of hanger rods 48 is hooked around the interleaving hinges on each side of the shelf. With the second and third arms placed under a table so that the outer end of the third arms contact the underside of the table the work stand is shoved forward until the first horizontal legs extends over the table edge. When suspended in a horizontal position the weight on the shelf is compensated by a balancing moment between the contact of the first horizontal legs and the third arms on the table and the reaction of the table thereto.

When preparing the work stand for depositing it in a briefcase the operation discussed above is reversed but detailed herein more completely. The hanger rods 48 are removed from the interleaving hinges 38, and the extended first, second and third arms are folded sideways on the ball and socket hinges 24 until the inner sides 18 of the first arms 15 rests on the lower surface 14 of the shelf 11. Then the second arms 31 together with the third arms 43 are folded back on the interleaving hinges to place the outer side 33 of the second arms on the outer sides 19 of the first arms. The third arms are turned inwardly on the scarfed hinge 42, and when the hanger rods are placed between the folded arms all elements of the work stand 10 are stacked on the shelf. The peripheral dimension and height of the stacked shelf 54 can be enclosed in a briefcase.

From the aforegoing description and illustration of the present invention it is obviously an improvement and provides important advantages over the prior art.

The above description is to be clearly understood to be given by illustration and example only, the spirit and scope of the present invention being limited solely by the appended claims.

I claim:

1. A foldable work stand adapted to be suspended from a table for supporting a typewriter thereon wherein said foldable work stand can be enclosed in a conventional briefcase, comprising: a shelf comprising upper and lower surfaces and one pair of opposite side edges longer than the other pair of side edges, a first pair of foldable arms mounted separately on the lower surface adjacent to the longer sides edges having outer and inner sides, side edges, ends and a first hinge connection on an outer end including a first hole extending therethrough parallel to the sides, a multiplicity of spaced hinges with two of each having a flange portion connected to the side edge of each of the first arms and the other portion to said lower surface adapted to rotate the sides of said first arms from said lower surface to an upright position normal thereto, a second pair of foldable arms with similar sides, edges and ends having a second hinge connection on an inner end with a second hole bored therethrough and a pin for rotating the second hinge connection in registary with the first hinge connection and further including a third hinge connection on the outer end together with a third hole bored transversely therethrough, a third pair of dissimilar arms comprising spaced sides, ends and a fourth hinge connection on the inner end having a fourth hole extending transversely therethrough in alignment with the third hole including a pin therein adapted to rotatably connect the fourth hinge connection on the third hinge connection, a pair of hanger rods consisting of a first horizontal leg, a semi-arcuate shaped vertical leg and a second lesser horizontal leg connected at the lower end of the vertical leg extending normal to the first horizontal leg and connected at the outer end to a second lesser vertical leg thereby forming a U-shaped portion engaging said first hinge connection on said first arms, said hanger rods defining readily removable means for suspending the work stand from a table in a horizontal position wherein said U-shaped portions of said hanger rods are adapted to be hooked around said first connections and wherein said second and third arms extend under the table and said third arms rotate upwardly in contact with the lower surface and wherein said first horizontal legs are adapted to be placed over the edge of said table for supporting the work stand therewith.

2. A foldable stand as cited in claim 1, wherein: said shelf is a rectangular relatively thin support.

3. A foldable stand as cited in claim 1, wherein: said first hinge connection is an enlarged semi-cylindrical hinge extension on said outer side of said first arms extending along the outer end and has a length equal to the space between the opposite side edges, the extension being shaped in alternate comb-like ledges and spaces.

4. A foldable stand as cited in claim 3, wherein: said first hinge connection further includes a groove extending lengthwise in the center of a peripheral edge of the semi-cylindrical ledges.

5. A foldable stand as cited in claim 4, wherein: said second hinge connection is a similar enlarged semi-cylindrical hinge extension on the outer side of said second arms formed with said ledges and spaces for interleaving with said first hinge connection, and includes a groove in said ledges adapted to mesh together and provide a common groove for receiving therein the second vertical leg portion of said hanger rods.

6. A foldable stand as cited in claim 1, wherein: said third and fourth hinge connections combined form a scarfed dovetail joint whereon said inner end of said fourth hinge connection is partially rounded to limit rotational movement of said third arms 90° perpendicular to said inner sides of said first and second arms.

7. A foldable work stand adapted to be suspended from a table for supporting typewriter thereon wherein said foldable work stand can be enclosed in a conventional briefcase, comprising:

a rectangular shelf comprising upper and lower surfaces and one pair of longer side edges 16 inches and the other pair 10½ inches, a first pair of foldable arms with each mounted separately on the lower surfaces adjacent to each of the longer side edges comprising outer and inner sides, side edges, opposite ends and an expansion of the sides into a first enlarged semi-cylindrical hinge connection having a row of alternating ledges and spaces on the outer end including a first hole extending therethrough parallel to the sides, at least four spaced hinges with two of each having a flange portion connected to the side edge of each of the first arms and the outer portion to said lower surface adapted to rotate the sides of said first arms forms said lower surface to an upright position normal thereto, a second pair of foldable arms with similar sides, edges, ends and a second enlarged semi-cylindrical hinge connection on an inner end having a row of interleaving ledges and spaces with a second hole bored therethrough including a pin for rotating it in registry with the first hinge connection, and further including a third hinge connection on the outer end together with a third hole bored transversely therethrough, a third pair of dissimilar arms with spaced sides, ends and a fourth hinge connection on the inner end including a fourth hole bored transversely therethrough in alignment with the third hole and a pin for rotatably connecting the fourth hinge connection to the third hinge connection, the third arms being of lesser length than said first and second arms, a pair of hanger rods consisting of a first horizontal leg, a semi-arcuate shaped vertical leg and a second lesser horizontal leg connected at the lower end of the vertical leg extending perpendicular to the first horizontal leg and connected at the outer end to a second lesser vertical leg thereby forming a U-shaped portion hooking around said first hinge connection on said first arms said hanger rods defining readily removable means for suspending the work stand below a table top in a horizontal position wherein said U-shaped portions of said rods are adapted to be hooked around the lower portion of said first connections and wherein said second and third arms extend under the table and said third arms rotate upwardly to engage the lower surface of said table whereupon said first horizontal legs are adapted for placement over said table edge to support said work stand therewith.

8. A foldable stand as cited in claim 7, wherein: said first and second enlarged semi-cylindrical connections together form the interleaving hinge and when extended in a straight unfolded alignment the outer and inner ends respectively of said first and second arms are locked in abutting ends and when being folded said ends have rotatably separated 180° apart.

9. A foldable stand as recited in claim 7, wherein: the four hinges are a ball-socket type which comprise an attachable flange having a ball headed stem mounted intermediate of the ends, the stem is embedded upright in the side edge of said first arms and the inner sides thereof are slotted to allow said first arms access to fold 90° out of the slotted sides and rest on said shelf.

10. A foldable stand as cited in claim 8, wherein: said first and second hinge connections further include a groove extending lengthwise in the center of a peripheral edge of the semi-cylindrical ledges and when joined together in an interleaving hinge provides a contiguous groove for receiving therein the second vertical leg portion of said respective hanger rod and prevents slippage therebetween.

11. A foldable stand as cited in claim 7, wherein: said third and fourth hinge connections combined together form a scarfed dovetail hinge whereon the inner end of said fourth connections overlapping the outer end of said third connections comprise partially rounded portions to limit rotation of said third arms on the scarfed dovetail hinge 90° perpendicular to the inner side of said second arms.

12. A foldable stand as cited in claim 7, wherein: said hanger rods provide a balancing amount of the weight at the center of said shelf times the distance to a contact of said horizontal legs of said hanger rods on said table being equal to the pressure of said table on the up turned third arms times the distance to the contact of said horizontal legs.

13. A foldable stand as cited in claim 11, wherein: said hanger rods further include a friction-like sleeve for enclosing said first horizontal legs to provide gripping means on said table.

* * * * *